US007631858B2

(12) United States Patent
Harada

(10) Patent No.: US 7,631,858 B2
(45) Date of Patent: Dec. 15, 2009

(54) FOLDED PORTION FLATTENING UNIT, POST-TREATMENT DEVICE, AND IMAGE FORMING APPARATUS

(75) Inventor: Katsunori Harada, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 364 days.

(21) Appl. No.: 11/513,180

(22) Filed: Aug. 31, 2006

(65) Prior Publication Data

US 2007/0081877 A1 Apr. 12, 2007

(30) Foreign Application Priority Data

Oct. 7, 2005 (JP) ..... 2005-294426
Oct. 7, 2005 (JP) ..... 2005-294428

(51) Int. Cl.
*B65H 37/04* (2006.01)

(52) U.S. Cl. ..... 270/58.07; 270/32; 270/37; 270/45; 270/51; 270/58.01

(58) Field of Classification Search ..... 270/32, 270/37, 45, 51, 58.01, 58.07; 412/10, 11, 412/18, 22
See application file for complete search history.

(56) References Cited

U.S. PATENT DOCUMENTS 3,954,548 A * 5/1976 Polit ..... 156/477.1
6,168,363 B1 * 1/2001 Nehring ..... 412/30
2005/0008460 A1 * 1/2005 Watkiss ..... 412/9
2005/0179190 A1 * 8/2005 Kamiya et al. ..... 270/58.07
2006/0066831 A1 * 3/2006 Terao et al. ..... 355/68
2006/0153612 A1 * 7/2006 Saitsu et al. ..... 399/410

FOREIGN PATENT DOCUMENTS

JP 2001-260564 9/2001

* cited by examiner

*Primary Examiner*—Gene Crawford
*Assistant Examiner*—Leslie A Nicholson, III
(74) *Attorney, Agent, or Firm*—Morgan, Lewis & Bockius LLP

(57) ABSTRACT

A folded portion flattening unit includes: a sheet conveyance unit that conveys a booklet including a folded sheet with a folded portion in a lead toward a predetermined conveyance direction; a sheet stopper that stops the booklet conveyed by the sheet conveyance unit at a predetermined position; a pair of booklet grasping members that clamp and grasp the booklet stopped by the sheet stopper at both faces of the booklet; a pressing member that flattens a curve at a front end of the folded portion being grasped by the booklet grasping members, by pressing the front end toward a direction opposite to the conveyance direction; and an opening amount setting unit that sets an opening amount of an opening portion between the pair of booklet grasping members, when the conveyed booklet is sandwiched between the pair of booklet grasping members.

6 Claims, 8 Drawing Sheets

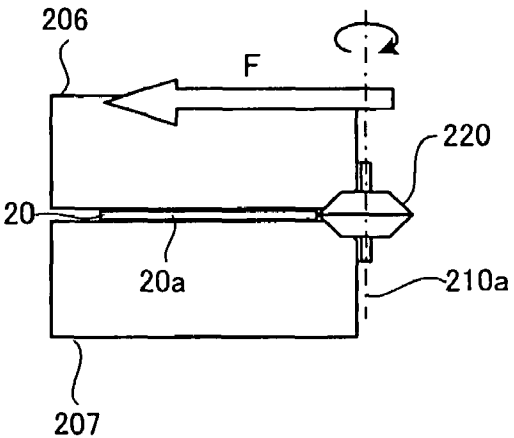
Fig. 12A
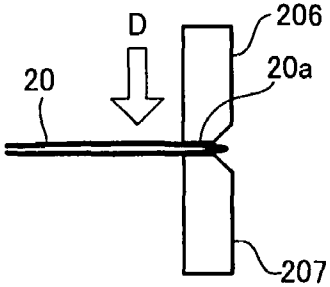
Fig. 12B
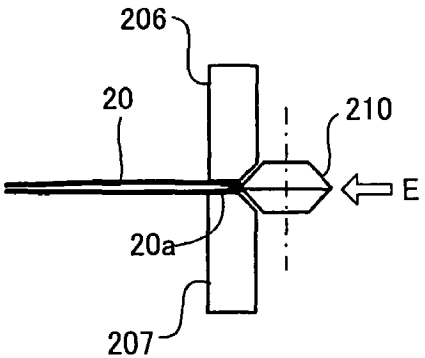
Fig. 12C
Fig. 12D

FOLDED PORTION FLATTENING UNIT, POST-TREATMENT DEVICE, AND IMAGE FORMING APPARATUS

BACKGROUND (i) Technical Field

The present invention relates to a folded portion flattening unit incorporated into a post-treatment device which performs various post-treatments to a sheet in which an image is formed by an image forming apparatus, the post-treatment unit, and the image forming apparatus.

(ii) Related Art

Recently, the online image forming apparatus is being promoted, and the post-treatment device for performing various post-treatments to the sheet in which the image is already formed has been widely used. Examples of the post-treatment include a stapling treatment, a bookbinding treatment, and a punching treatment.

For example, as shown in FIG. 1, an image forming apparatus 1 such as an electrophotographic printer and an electrophotographic copying machine and a post-treatment device 2 connected to the image forming apparatus 1 are well known. The post-treatment device 2 performs various post-treatments to the sheet in which the image is already formed by the image forming apparatus 1. The post-treatment device 2 includes a transport unit 3, an intermediate treatment unit 4, and a final treatment unit 5. The transport unit 3 receives the sheet from the image forming apparatus 1. The intermediate treatment unit 4 performs various intermediate treatments to the sheet taken in by the transport unit 3, and examples of the intermediate treatment include a half-folding treatment, the stapling treatment, a saddle stitching treatment, and an interposing treatment. The final treatment unit 5 performs various final treatments to the sheet delivered from the intermediate treatment unit 4. The final treatment unit 5 includes a trimming unit 6, a folded portion flattening unit 7, a punching treatment unit 8, and a stacker unit 9. The trimming unit 6 trims a sheet irregular portion at a rear end of the half-folded booklet. The folded portion flattening unit 7 flattens a curve of a folded portion at a front end of the booklet after the trimming treatment is performed. The punching treatment unit 8 performs the punching treatment near the booklet front-end portion after the flattening treatment is performed. The booklets are stacked on the stacker unit 9 after the punching treatment is performed.

When a booklet 10 which is half-folded by the intermediate treatment unit 4 is delivered to the trimming unit 6 of the final treatment unit 5 with a folded portion 10*a* in the lead as shown in FIG. 2A, a sheet irregular portion 10*b* at the rear end of the booklet 10 is trimmed by a movable blade 6*a* and a fixed blade 6*b* of a guillotine cutter which falls down toward an arrow direction as shown in FIG. 2B.

SUMMARY

The invention provides a folded portion flattening unit, a post-treatment device, and an image forming apparatus.

According to an aspect of the invention, a first folded portion flattening unit includes: a sheet conveyance unit that conveys a booklet of a folded sheet with a folded portion in a lead toward a predetermined conveyance direction; a sheet stopper that stops the booklet at a predetermined position, the booklet being conveyed by the sheet conveyance unit;

a pair of booklet grasping members that clamp and grasp the booklet stopped by the sheet stopper at both faces of the booklet; a pressing member that substantially flattens a curve at a front end of the folded portion of the booklet being grasped by the booklet grasping members, by pressing the front end of the folded portion toward a direction opposite to the conveyance direction; and an opening amount setting unit that sets an opening amount of an opening portion between the pair of booklet grasping members, when the conveyed booklet is sandwiched between the pair of booklet grasping members.

BRIEF DESCRIPTION OF THE DRAWINGS

Exemplary Embodiments of the present invention will be described in detail based on the following figures, wherein:

FIG. 12A, 12B, 12C and 12D are explanatory views showing an operation of the folded portion flattening unit shown in FIG. 11.

DETAILED DESCRIPTION

Exemplary embodiments of the invention will be described below with reference to the accompanying drawings.

Figure 1:
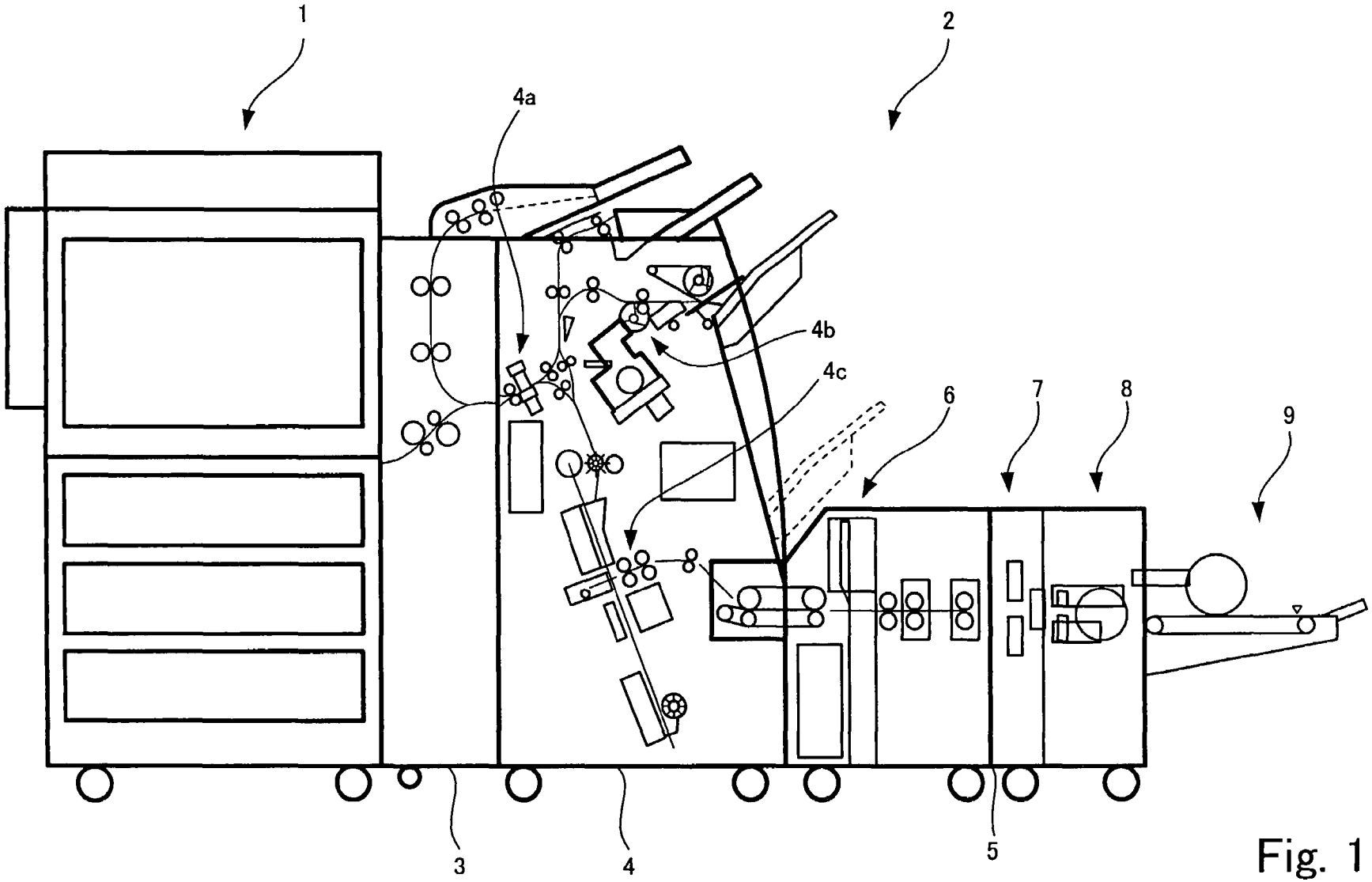
FIG. 1 is a block diagram showing a post-treatment device into which a folded portion flattening unit of a first embodiment is incorporated.

FIG. 1 is a block diagram showing a post-treatment device into which a folded portion flattening unit of a first exemplary embodiment is incorporated.

FIG. 1 shows a post-treatment device 2 connected to an image forming apparatus 1 such as a printer and a copying machine. The post-treatment device 2 includes a transport unit 3, an intermediate treatment unit 4, and a final treatment unit 5. The transport unit 3 receives a sheet from the image forming apparatus 1. The intermediate treatment unit 4 includes a punching treatment section 4*a* which performs a punching treatment to the sheet taken in by the transport unit 3, a stapling treatment section 4*b* which performs a stapling treatment, and a half-fold treatment section 4*c* which performs a half-fold treatment. A final treatment unit 5 performs various final treatments to the sheet delivered from the intermediate treatment unit 4. The image forming apparatus 1 corresponds to an example of the image forming unit according to an aspect of the invention. A combination of the image forming apparatus 1 and the post-treatment device 2 corresponds to an example of the image forming apparatus according to the aspect of the invention.

The final treatment unit 5 includes a trimming unit 6, a folded portion flattening unit 7, a punching treatment section 8, and a stacker unit 9. The trimming unit 6 trims a sheet irregular portion at a rear end of the half-folded booklet. The folded portion flattening unit 7 flattens a curve at a front end of the trimmed folded booklet. The punching treatment section 8 performs the punching treatment near the flattened booklet front-end portion. The booklets to which the punching treatment is already performed are stacked in the stacker unit 9.

Figure 2A:
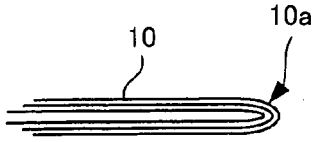
FIG. 2A, 2B and 2C are schematic diagrams of a trimming unit incorporated into a final treatment unit of the post-treatment device shown in FIG. 1.
Figure 2B:
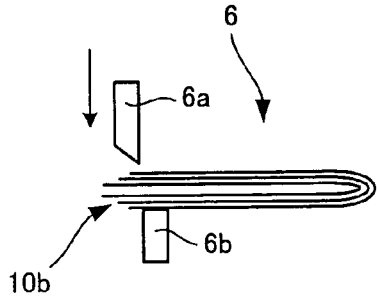
Figure 2C:
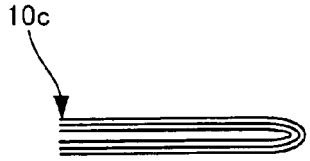

FIGS. 2A to 2C are a schematic diagram of the trimming unit 6 incorporated into the final treatment unit 5 of the post-treatment device 2 shown in FIG. 1.

When a booklet 10 which is half-folded by the intermediate treatment unit 4 (see FIG. 1) is delivered to the trimming unit 6 of the final treatment unit 5 with a folded portion 10*a* in the lead as shown in FIG. 2A, a sheet irregular portion 10*b* at the rear end of the booklet 10 is trimmed by a movable blade 6*a* and a fixed blade 6*b* of a guillotine cutter which falls down toward an arrow direction as shown in FIG. 2B. As shown in FIG. 2C, the rear end portion 10*c* of the booklet 10 is trimmed, which produces the booklet 10 in which the page is easily turned over.

Figure 3A:
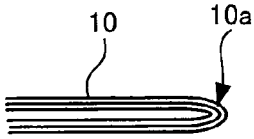
FIG. 3A, 3B and 3C are schematic diagrams of the folded portion flattening unit incorporated into the final treatment unit of the post-treatment device shown in FIG. 1.
Figure 3B:
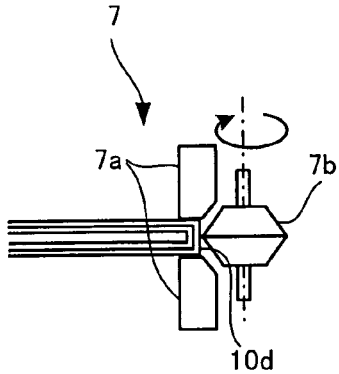
Figure 3C:
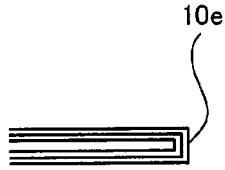

FIGS. 3A to 3C are a schematic diagram of the folded portion flattening unit 7 incorporated into the final treatment unit 5 of the post-treatment device 2 shown in FIG. 1.

When the booklet 10 whose rear end is trimmed by the trimming unit 6 (see FIG. 2) is delivered to the folded portion flattening unit 7 with the folded portion 10*a* in the lead as shown in FIG. 3A, the booklet 10 is clamped and grasped by a pair of booklet grasping members 7*a* included in the folded portion flattening unit 7 as shown in FIG. 3B. As shown in FIG. 3C, in the front end 10*a* of the folded portion, the curve 10*d* at the front end is pressed by a roller 7*b* to finally form the flattened flat surface 10*e*.

The detailed folded portion flattening unit of the first exemplary embodiment will be described later with reference to FIG. 5.

FIG. 4 is a schematic diagram of the punching treatment section 8 incorporated into the final treatment unit 5 of the post-treatment device 2 shown in FIG. 1.

Figure 4A:
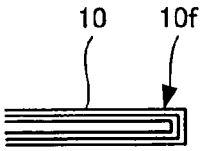
FIG. 4A, 4B and 4C are schematic diagrams of a punching treatment section incorporated into the final treatment unit of the post-treatment device shown in FIG. 1.
Figure 4B:
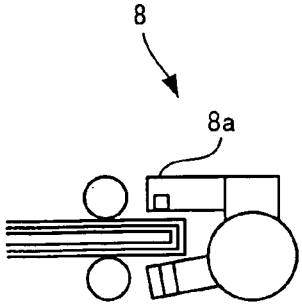
Figure 4C:
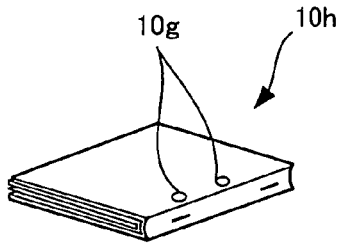

The booklet flattened by the folded portion flattening unit 7 (see FIGS. 3A through 3C) is delivered to the punching treatment section 8 as shown in FIG. 4A, the puncher 8*a* performs the punching treatment near the booklet front-end portion 10*f* as shown in FIG. 4B, and punch holes 10*g* are made to complete a booklet 10*h* as shown in FIG. 4C.

Figure 5:
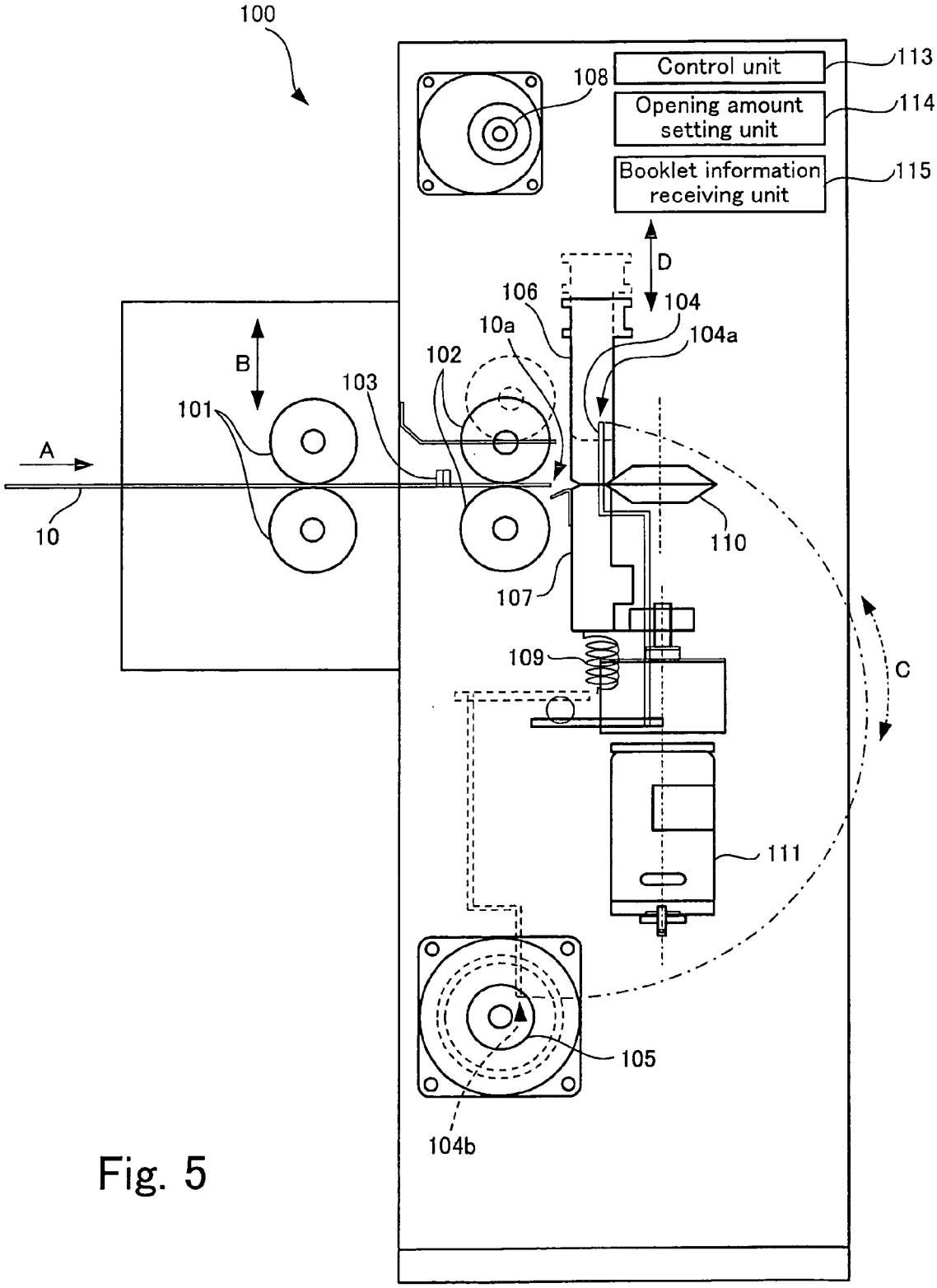
FIG. 5 shows a block diagram showing the folded portion flattening unit according to the first embodiment of the invention.

FIG. 5 shows a block diagram showing the folded portion flattening unit according to the first exemplary embodiment.

A folded portion flattening unit 100 of the first exemplary embodiment shown in FIG. 5, which corresponds to the folded portion flattening unit 7 in FIG. 1, is used while incorporated into the final treatment unit 5 of the post-treatment device 2 shown in FIG. 1.

As shown in FIG. 5, the folded portion flattening unit 100 includes a sheet conveyance unit, a sheet stopper 104, a sheet stopper motor 105, a pair of booklet grasping members 106 and 107, a grasping member drive motor 108, a spring 109, and a roller 110. In the folded portion flattening unit 100, the curve at the front end of the booklet folded portion 10*a* is flattened to form the flat surface at the front end of the folded portion 10*a* by the roller 110. The sheet conveyance unit includes sheet conveyance rollers 101, clamp rollers 102, and a sheet detection sensor 103. The sheet conveyance rollers 101 conveys the booklet 10 including the folded sheet toward a conveyance direction shown by an arrow A with the folded portion 10*a* in the lead, and the clamp rollers 102 clamp the conveyed booklet 10. The sheet stopper 104 stops the booklet 10 conveyed by the sheet conveyance unit at a predetermined position. The sheet stopper motor 105 moves the sheet stopper 104 between an actuated position 104*a* and a standby position 104*b* in the direction of an arrow C. The pair of booklet grasping members 106 and 107 clamps and grasps the booklet 10 stopped by the sheet stopper 104. The grasping member drive motor 108 vertically moves the booklet grasping member 106 in the direction of an arrow D. The spring 109 presses the booklet grasping member 107 against the booklet 10. The roller 110 presses the front end of the folded portion 10*a* of the booklet 10 grasped by the booklet grasping members 106 and 107 toward the opposite direction to the conveyance direction A. The folded portion flattening unit 100 also includes an opening amount setting unit 114 which sets an opening amount O of an opening portion formed between the pair of booklet grasping members 106 and 107 when the conveyed booklet 10 is sandwiched between the pair of booklet grasping members 106 and 107.

The folded portion flattening unit 100 of the first exemplary embodiment has a booklet information receiving unit 115. The booklet information receiving unit 115 is incorporated into the post-treatment device 2 (see FIG. 1). The post-treatment device 2 receives the sheet in which the image is formed by the image forming apparatus 1 (see FIG. 1) connected to the folded portion flattening unit 100, and the post-treatment device 2 half-folds and delivers the sheets. The booklet information receiving unit 115 receives booklet information which forms the basis for setting the opening amount from the image forming apparatus 1. The opening amount setting unit 114 is configured to set the opening amount based on the booklet information received by the booklet information receiving unit 115.

The roller 110 of the first exemplary embodiment corresponds to the pressing member according to the aspect of the invention, and the roller 110 includes a roller which is rotated while pressing the folded portion toward a longitudinal direction. The roller 110 is configured to be moved between the operating position and the standby position (not shown) by a roller moving motor 111.

As shown in FIG. 5, a roller surface of the roller 110 which presses the front end of the folded portion is formed in an abacus bead-shape. In pressing the front end of the folded portion of the booklet 10, although the slightly concave surface is formed at the front end of the folded portion, the concave surface disappears instantly to form the flat surface after pressing the front end.

The folded portion flattening unit 100 includes a control unit 113 which comprehensively controls operations of the sheet conveyance rollers 101, the clamp rollers 102, the sheet detection sensor 103, the sheet stopper 104, the sheet stopper motor 105, the booklet grasping members 106 and 107, the grasping member drive motor 108, the roller 110, the roller moving motor 111, the opening amount setting unit 114, the booklet information receiving unit 115, and the like.

Then, an operation of the folded portion flattening unit 100 will be described with reference to FIGS. 5 and 6A through 6D.

FIGS. 6A to 6D are an explanatory view showing an operation of the folded portion flattening unit shown in FIG. 5.

In the configuration of the folded portion flattening unit 100 of the first exemplary embodiment, the booklet information receiving unit 115 receives the booklet information from the image forming apparatus 1 (see FIG. 1) and the opening amount setting unit 114 sets the opening amount based on the booklet information. The booklet information forms the basis for setting the opening amount of the opening portion between the booklet grasping members 106 and 107. Examples of the booklet information include the number of sheets, a sheet size, a sheet thickness, and a type of sheet which constitutes the booklet.

Figure 6D:
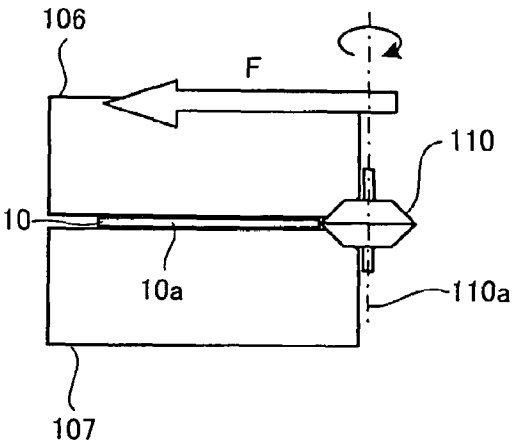
FIG. 6A, 6B, 6C and 6D are explanatory views showing an operation of the folded portion flattening unit shown in FIG. 5.
Figure 6C:
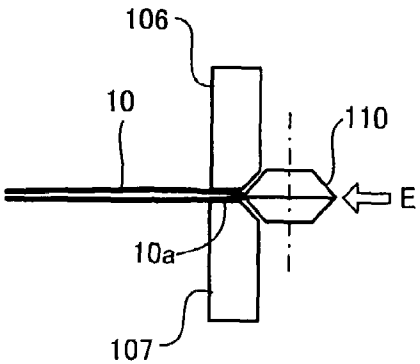
Figure 6B:
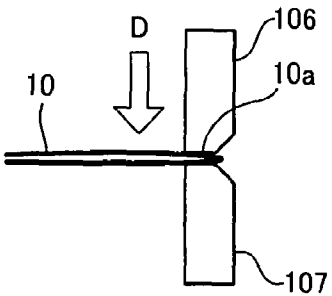
Figure 6A:
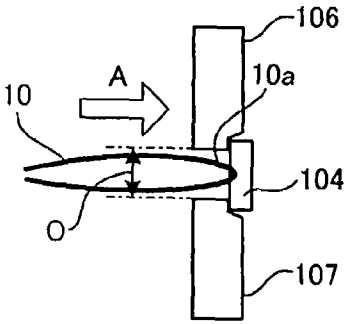

In the folded portion flattening unit 100, as shown in FIG. 6A, the booklet 10 including the folded sheet are delivered with the folded portion 10*a* in the lead into the opening portion of the booklet grasping members 106 and 107 which is set at the opening amount O predetermined by the opening amount setting unit 114.

In the first exemplary embodiment, the opening amount O is set based on the booklet information received from the image forming apparatus 1 by the opening amount setting unit 114. Therefore, it is possible to prevent a problem that the booklet cannot enter the opening portion because the booklet has the thickness larger than the opening amount O between the pair of booklet grasping members 7*a*, and there is also prevented the problem that the booklet rises in the opening portion of the booklet grasping members 7*a* because the booklet has the thickness smaller than the opening amount O.

The clamp rollers 102 clamp and convey the conveyed booklet in the direction of the arrow A in conjunction with the sheet conveyance rollers 101, and the folded portion 10*a* reaches a predetermined position, namely, the folded portion 10*a* abuts on the sheet stopper 104 which is moved to the actuated position 104*a* by the sheet stopper motor 105. At this point, the conveyance is ended.

In the conveyance procedure, when the sheet detection sensor 103 arranged in front of the clamp rollers 102 detects the booklet approach, the sheet detection sensor 103 sends a detection signal to the control unit 113, and the control unit 113 performs the sheet conveyance controls with the sheet conveyance rollers 101 and the clamp rollers 102 based on the detection signal from the sheet detection sensor 103.

At this point, when the control unit 113 receives information that the booklet 10 abuts on the sheet stopper 104, the control unit 113 places priority on the information and performs the control such that the conveyance of the booklet 10 is ended.

When the conveyance of the booklet 10 is ended, the sheet stopper 104 is moved to the standby position 104*b* by the sheet stopper motor 105, the booklet grasping member 106 is moved downward by the grasping member drive motor 108 as shown in FIG. 6B, and the booklet grasping member 106 and the booklet grasping member 107 located below clamp and grasp the booklet 10 at both faces of the booklet. The booklet 10 is grasped with predetermined grasping force, because the booklet grasping member 107 is supported through the spring 109 against a chassis of the folded portion flattening unit 100.

Then, as shown in FIG. 6C, the roller 110 is moved to the predetermined position by the roller moving motor 111.

FIG. 6D is a view when FIG. 6C is viewed from the direction of the arrow E.

As shown in FIG. 6D, the roller 110 travels in the direction of the arrow F, namely, in the longitudinal direction of the folded portion 10*a* of the booklet 10 while rotated about a rotation axis 110*a*, which allows the roller 110 to press the front end of the folded portion 10*a* of the booklet 10 grasped by the booklet grasping members 106 and 107 toward a direction opposite to the conveyance direction A. Therefore, the curve is flattened at the front end of the folded portion 10*a* of the booklet 10 and the flat surface 10*e* (see FIG. 3C) is formed at the front end of the folded portion 10*a*.

Thus, according to the folded portion flattening unit of the first exemplary embodiment, the opening amount setting unit sets the opening amount based on the booklet information received from the image forming apparatus. Therefore, there is generated no problem that the booklet having the thickness larger than the opening amount between the booklet grasping members cannot enter the opening portion. There is also prevented the problem that the evenly flat surface is not obtained in the case where when the booklet having the thickness smaller than the opening amount is conveyed, a degree of freedom for the booklet is increased to generate the rise of the booklet in the opening portion of the booklet grasping members, and the sheets are grasped while curled.

Figure 7:
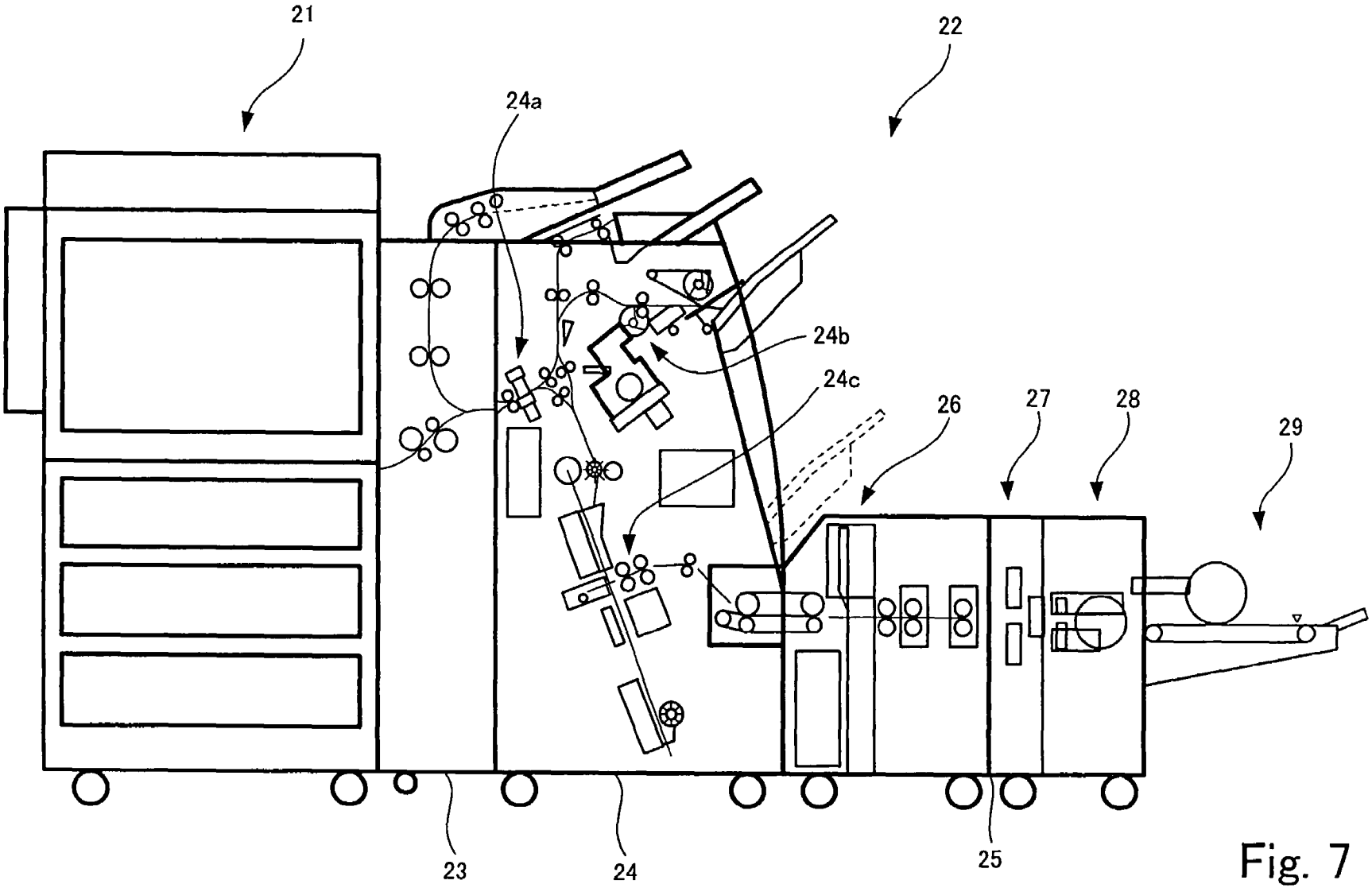
FIG. 7 is a block diagram showing a post-treatment device into which a folded portion flattening unit of a second embodiment is incorporated.

FIG. 7 is a block diagram showing a post-treatment device into which a folded portion flattening unit according to a second exemplary embodiment of the invention is incorporated.

FIG. 7 shows a post-treatment device 22 connected to an image forming apparatus 21 such as a printer and a copying machine. The post-treatment device 22 includes a transport unit 23, an intermediate treatment unit 24, and a final treatment unit 25. The transport unit 23 receives a sheet from the image forming apparatus 21. The intermediate treatment unit 24 includes a punching treatment section 24*a* which performs a punching treatment to the sheet taken in by the transport unit 23, a stapling treatment section 24*b* which performs a stapling treatment, and a half-fold treatment section 24*c* which performs a half-fold treatment. The final treatment unit 25 performs various final treatments to the sheet delivered from the intermediate treatment unit 24. The image forming apparatus 21 corresponds to an example of the image forming unit according to another aspect of the invention. A combination of the image forming apparatus 21 and the post-treatment device 22 corresponds to an example of the image forming apparatus according to another aspect of the invention.

The final treatment unit 25 includes a trimming unit 26, a folded portion flattening unit 27, a punching treatment section 28, and a stacker unit 29. The trimming unit 26 trims the sheet irregular portion at the rear end of the half-folded booklet. The folded portion flattening unit 27 flattens a curve at the front end of the trimmed folded portion. The punching treatment section 28 performs the punching treatment near the flattened booklet front-end portion. The booklets to which the punching treatment is already performed are stacked in the stacker unit 29.

Figure 8A:
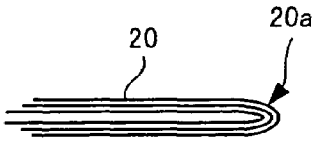
FIG. 8A, 8B and 8C are schematic diagrams of a trimming unit incorporated into a final treatment unit of the post-treatment device shown in FIG. 7.
Figure 8B:
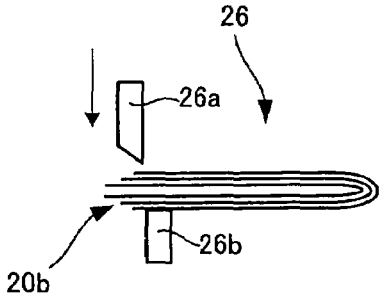
Figure 8C:
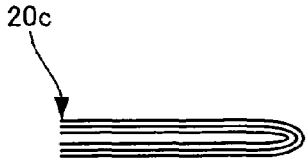

FIGS. 8A to 8C are a schematic diagram of the trimming unit 26 incorporated into the final treatment unit 25 of the post-treatment device 22 shown in FIG. 7.

When a booklet 20 which is half-folded by the intermediate treatment unit 24 (see FIG. 7) is delivered to the trimming unit 26 of the final treatment unit 25 with a folded portion 20*a* in the lead as shown in FIG. 8A, a sheet irregular portion 20*b* at the rear end of the booklet 20 is trimmed by a movable blade 26*a* and a fixed blade 26*b* of a guillotine cutter which falls down toward an arrow direction as shown in FIG. 8B. As shown in FIG. 8C, the rear end portion 20*c* of the booklet 20 is trimmed, which produces the booklet 20 whose pages can be easily turned over.

Figure 9A:
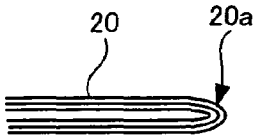
FIG. 9A, 9B and 9C are schematic diagrams of the folded portion flattening unit incorporated into the final treatment unit of the post-treatment device shown in FIG. 7.
Figure 9B:
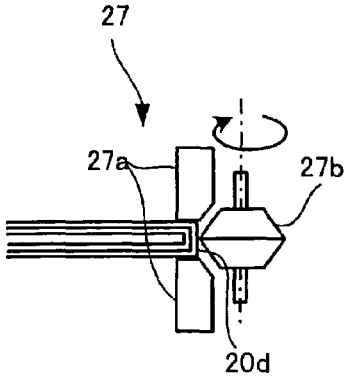
Figure 9C:
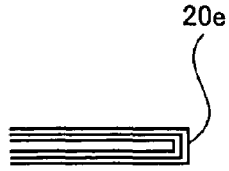

FIGS. 9A to 9C area schematic diagram of the folded portion flattening unit incorporated into the final treatment unit 25 of the post-treatment device 22 shown in FIG. 7.

When the booklet 20 whose rear end is trimmed by the trimming unit 26 (see FIG. 8) is delivered to the folded portion flattening unit 27 with the folded portion 20*a* in the lead as shown in FIG. 9A, the booklet 20 is clamped and grasped by a pair of booklet grasping members 27*a* included in the folded portion flattening unit 27 as shown in FIG. 9B. As shown in FIG. 9C, in the front end 20*a* of the folded portion, the curve 10*d* at the front end is pressed by a roller 27*b* to form finally the flattened flat surface 20*e*.

The detailed folded portion flattening unit 27 of the second exemplary embodiment will be described later with reference to FIG. 11.

FIG. 10 is a schematic diagram of the punching treatment section 24*a* incorporated into the final treatment unit 25 of the post-treatment device 22 shown in FIG. 7.

Figure 10A:
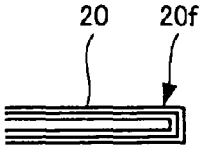
FIG. 10A, 10B and 10C are schematic diagrams of a punching treatment section incorporated into the final treatment unit of the post-treatment device shown in FIG. 7.
Figure 10B:
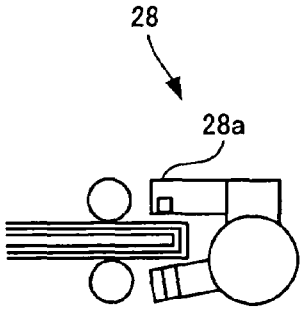
Figure 10C:
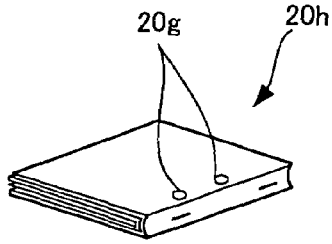

The booklet flattened by the folded portion flattening unit 27 (see FIG. 9) is delivered to the punching treatment section 28 as shown in FIG. 10A, the puncher 28*a* performs the punching treatment near the booklet front-end portion 20*f* as shown in FIG. 10B, and punch holes 20*g* are made to complete a booklet 20*h* as shown in FIG. 10C.

Figure 11:
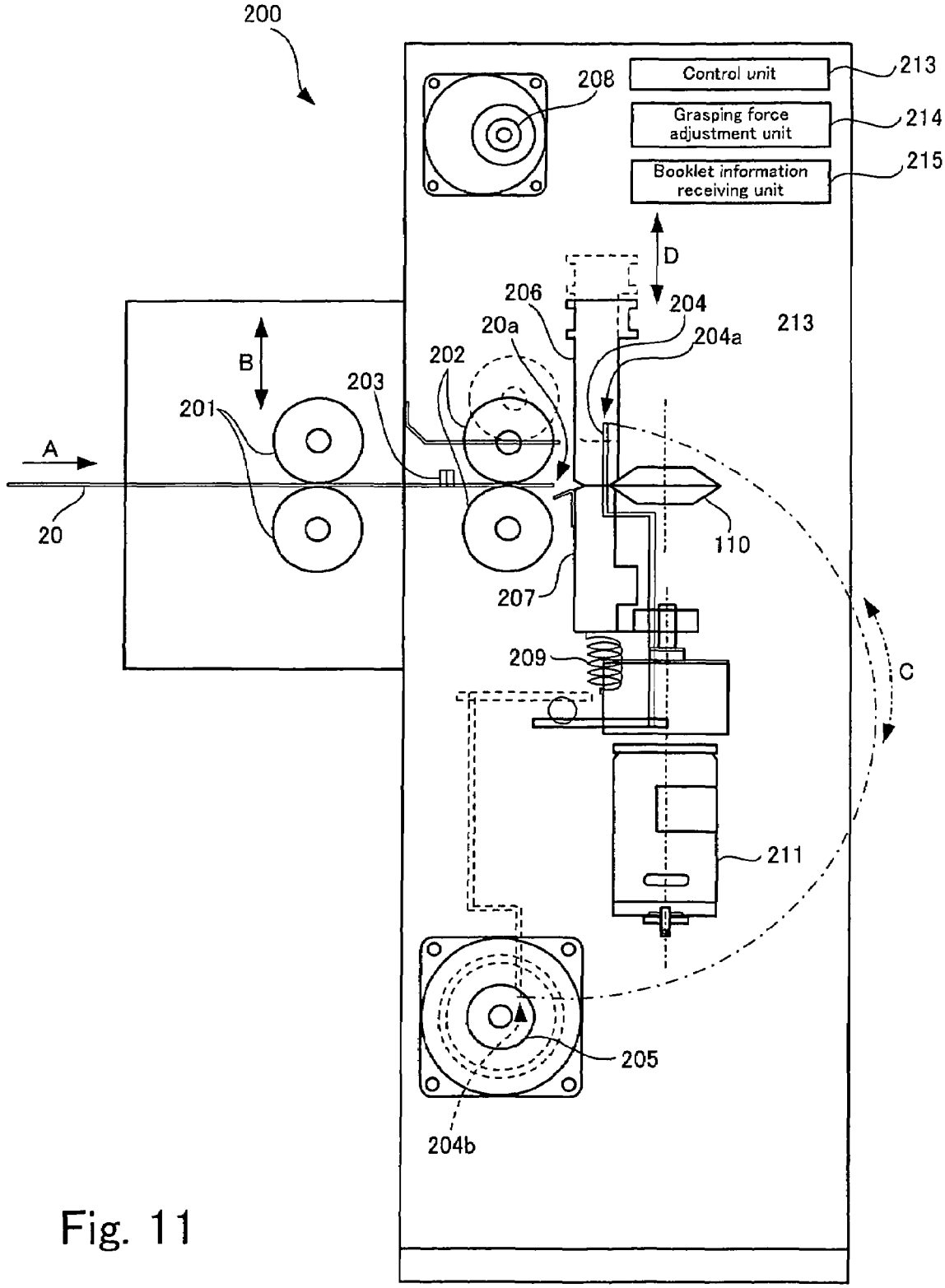
FIG. 11 is a schematic diagram showing a folded portion flattening unit according to the second embodiment of the invention.

FIG. 11 is a schematic diagram showing the folded portion flattening unit according to the second exemplary embodiment.

A folded portion flattening unit 200 shown in FIG. 11, which corresponds to the folded portion flattening unit 27 in FIG. 7, is used while incorporated into the final treatment unit 25 of the post-treatment device 22 shown in FIG. 7.

As shown in FIG. 11, the folded portion flattening unit 200 includes a sheet conveyance unit, a sheet stopper 204, a sheet stopper motor 205, a pair of booklet grasping members 206 and 207, a grasping member drive motor 208, a spring 209, and a roller 210. In the folded portion flattening unit 200, the curve at the front end of the booklet folded portion 20*a* is flattened to form the flat surface at the front end of the folded portion 20*a* by the roller 210. The sheet conveyance unit includes sheet conveyance rollers 201, clamp rollers 202, and a sheet detection sensor 203. The sheet conveyance rollers 201 conveys the booklet 20 including the folded sheet toward a conveyance direction shown by an arrow A with the folded portion 20*a* in the lead, and the clamp rollers 202 clamps the conveyed booklet 20. The sheet stopper 204 stops the booklet 20 conveyed by the sheet conveyance unit at a predetermined position. The sheet stopper motor 205 mutually moves the sheet stopper 204 between an actuated position 204*a* and a standby position 204*b* in the direction of an arrow C. The pair of booklet grasping members 206 and 207 clamps and grasps the booklet 20 stopped by the sheet stopper 204. The grasping member drive motor 208 vertically moves one of the booklet grasping member 206 in the direction of an arrow D. The spring 209 presses the other grasping member 207 against the booklet 20. The roller 210 presses the front end of the folded portion 20*a* of the booklet 20 grasped by the booklet grasping members 206 and 207 toward the opposite direction to the conveyance direction A. The folded portion flattening unit 200 also includes an grasping force adjustment unit 214 which adjusts the grasping force by the pair of booklet grasping members 206 and 207 when the pair of booklet grasping members 206 and 207 clamp and grasp the booklet 20 at the both faces thereof that is stopped by the sheet stopper 204.

The folded portion flattening unit 200 of the second exemplary embodiment has a booklet information receiving unit 215. The booklet information receiving unit 215 is incorporated into the post-treatment device 22 (see FIG. 7). The post-treatment device 22 receives the sheet in which the image is formed by the image forming apparatus 21 (see FIG. 7) connected to the folded portion flattening unit 200, and the post-treatment device 22 half-folds and delivers the sheets. The booklet information receiving unit 215 receives booklet information, from the image forming apparatus 21, which forms the basis for setting the opening amount between the booklet grasping members 206 and 207. Examples of the booklet information include the number of sheets, the sheet size, the sheet thickness, and the type of sheet which constitutes the booklet. The grasping force adjustment unit 214 is configured to adjust the grasping force based on the booklet information received by the booklet information receiving unit 215.

The roller 210 of the second exemplary embodiment corresponds to the pressing member according to another aspect of the invention, which includes a roller which is rotated while pressing the folded portion toward a longitudinal direction of the booklet. The roller 210 is configured to be moved between the operating position shown in FIG. 11 and the standby position (not shown) by a roller moving motor 211.

As shown in FIG. 9, a roller surface of the roller 210 which presses the front end of the folded portion is formed in the abacus bead-shape. In pressing the front end of the folded portion of the booklet 20, although the slightly concave surface is formed at the front end of the folded portion, the concave surface disappears instantly to form the flat surface after pressing the front end.

The folded portion flattening unit 200 includes control unit 213 which comprehensively controls operations of the sheet conveyance rollers 201, the clamp rollers 202, the sheet detection sensor 203, the sheet stopper 204, the sheet stopper motor 205, the booklet grasping members 206 and 207, the grasping member drive motor 208, the roller 210, the roller moving motor 211, the grasping force adjustment unit 214, the booklet information receiving unit 215, and the like.

Then, the operation of the folded portion flattening unit 200 will be described with reference to FIGS. 11 and 12.

FIGS. 12A to 12D are an explanatory view showing the operation of the folded portion flattening unit shown in FIG. 11.

In the configuration of the folded portion flattening unit of the second exemplary embodiment, the booklet information receiving unit 215 receives the booklet information from the image forming apparatus 21 (see FIG. 7) and the grasping force adjustment unit 214 adjusts the grasping force based on the booklet information. The booklet information forms the basis for adjusting the grasping force of the booklet grasping members 206 and 207. Examples of the booklet information include the number of sheets, the sheet size, the sheet thickness, and the type of sheet which constitutes the booklet.

As shown in FIG. 12A, when the booklet 20 including the folded sheet is delivered to the folded portion flattening unit 200 with the folded portion 20*a* in the lead, the clamp rollers 202 clamp and convey the conveyed booklet in the direction of the arrow A in conjunction with the sheet conveyance rollers 201, and the folded portion 20 a reaches a predetermined position, namely, the folded portion 20*a* abuts on the sheet stopper 204 which is moved to the actuated position 204*a* by the sheet stopper motor 205. At this point, the conveyance is ended.

In the conveyance procedure, when the sheet detection sensor 203 arranged in front of the clamp rollers 202 detect the booklet approach, the sheet detection sensor 203 sends a detection signal to the control unit 213, and the control unit 213 performs the sheet conveyance controls with the sheet conveyance rollers 201 and the clamp rollers 202 based on the detection signal from the sheet detection sensor 203.

At this point, when the control unit 213 receives information from the sheet stopper 204 that the booklet 20 a buts on the sheet stopper 204, the control unit 213 places priority on the information, and performs the control such that the conveyance of the booklet 20 is ended.

When the conveyance of the booklet 20 is ended, the sheet stopper 204 is moved to the standby position 204*b* by the sheet stopper motor 205, the booklet grasping member 206 is moved downward by the grasping member drive motor 208 as shown in FIG. 12B, and the booklet grasping member 206 and the booklet grasping member 207 located below clamp and grasp the booklet 20 at the both faces. At this point, the booklet 20 is grasped with the proper grasping force adjusted by the grasping force adjustment unit 214.

Then, as shown in FIG. 12C, the roller 210 is moved to the predetermined position by the roller moving motor 211.

FIG. 12D is a view when FIG. 12C is viewed from the direction of the arrow E.

As shown in FIG. 12D, the roller 210 travels in the direction of the arrow F, namely, in the longitudinal of the folded portion 20*a* of the booklet 20 while rotated about a rotation axis 210*a*, which allows the roller 210 to press the front end of the folded portion 20*a* of the booklet 20 grasped by the booklet grasping members 206 and 207 toward the opposite direction to the conveyance direction A. Therefore, the curve is flattened at the front end of the folded portion 20*a* of the booklet 20 and the flat surface 20*e* (see FIG. 9C) is formed at the front end of the folded portion 20*a*.

Thus, according to the folded portion flattening unit of the second exemplary embodiment, the grasping force adjustment unit 214 adjusts the grasping force of the booklet grasping members 206 and 207 based on the booklet information received from the image forming apparatus 21 (see FIG. 7). Examples of the booklet information include the number of sheets, the sheet size, the sheet thickness, and the type of sheet which constitutes the booklet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. A folded portion flattening unit comprising:

a sheet conveyance unit that conveys a booklet including a folded sheet with a folded portion in a lead toward a predetermined conveyance direction;

a sheet stopper that stops the booklet at a predetermined position, the booklet being conveyed by the sheet conveyance unit;

a pair of booklet grasping members that clamp and grasp the booklet stopped by the sheet stopper at both faces of the booklet;

a pressing member that substantially flattens a curve at a front end of the folded portion of the booklet being grasped by the booklet grasping members, by pressing the front end of the folded portion toward a direction opposite to the conveyance direction; and a grasping force adjustment unit that adjusts grasping force, the grasping force being generated by the pair of booklet grasping members when the pair of booklet grasping members grasp the booklet stopped by the sheet stopper, wherein the folded portion flattening unit is incorporated into a post-treatment device, the post-treatment device receiving the sheet that an image is formed on by an image forming apparatus connected to the folded portion flattening unit, the post-treatment device folding and delivering the sheet, the folded portion flattening unit includes a booklet information receiving unit that receives booklet information from the image forming apparatus, the booklet information forming the basis for adjusting the grasping force, and the grasping force adjustment unit adjusts the grasping force based on the booklet information received by the booklet information receiving unit, wherein the booklet information is a combination of the number of sheets, a sheet size, a sheet thickness, and a type of sheet.

2. A post-treatment device comprising:

an intermediate treatment unit that folds a sheet to produce a booklet;

a sheet conveyance unit that conveys the booklet with a folded portion in a lead toward a predetermined conveyance direction, the booklet being produced by the intermediate treatment unit;

a sheet stopper that stops the booklet at a predetermined position, the booklet being conveyed by the sheet conveyance unit;

a pair of booklet grasping members that clamp and grasp the booklet stopped by the sheet stopper at both faces of the booklet;

a pressing member that substantially flattens a curve at a front end of the folded portion of the booklet being grasped by the booklet grasping members, by pressing the front end of the folded portion toward a direction opposite to the conveyance direction; and a grasping force adjustment unit that adjusts grasping force, the grasping force being generated by the pair of booklet grasping members when the pair of booklet grasping members grasp the booklet stopped by the sheet stopper, wherein the post-treatment device includes a booklet information receiving unit that receives booklet information from an image forming apparatus, the booklet information forming the basis for adjusting the grasping force, and the grasping force adjustment unit adjusts the grasping force based on the booklet information received by the booklet information receiving unit, wherein the booklet information is a combination of the number of sheets, a sheet size, a sheet thickness, and a type of sheet.

3. An image forming apparatus comprising:

an image forming unit that forms an image on a sheet;

an intermediate treatment unit that folds the sheet to produce a booklet, the image being formed on the sheet by the image forming unit;

a sheet conveyance unit that conveys the booklet with a folded portion in a lead toward a predetermined conveyance direction, the booklet being produced by the intermediate treatment unit;

a sheet stopper that stops the booklet at a predetermined position, the booklet being conveyed by the sheet conveyance unit;

a pair of booklet grasping members that clamp and grasp the booklet stopped by the sheet stopper at both faces of the booklet;

a pressing member that substantially flattens a curve at a front end of the folded portion of the booklet being grasped by the booklet grasping members, by pressing the front end of the folded portion toward a direction opposite to the conveyance direction; and a grasping force adjustment unit that adjusts grasping force, the grasping force being generated by the pair of booklet grasping members when the pair of booklet grasping members grasp the booklet stopped by the sheet stopper, wherein the image forming apparatus includes a booklet information receiving unit that receives booklet information from the image forming unit, the booklet information forming the basis for adjusting the grasping force, and the grasping force adjustment unit adjusts the grasping force based on the booklet information received by the booklet information receiving unit, wherein the booklet information is a combination of the number of sheets, a sheet size, a sheet thickness, and a type of sheet.

4. A folded portion flattening unit comprising:

a sheet conveying means for conveying a booklet including a folded sheet with a folded portion in a lead toward a predetermined conveyance direction;

a sheet stopping means for stopping the booklet at a predetermined position, the booklet being conveyed by the sheet conveying means;

a pair of booklet grasping means for clamping and grasping the booklet stopped by the sheet stopping means at both faces of the booklet;

a pressing means for substantially flattening a curve at a front end of the folded portion of the booklet being grasped by the booklet grasping means, by pressing the front end of the folded portion toward a direction opposite to the conveyance direction; and a grasping force adjusting means for adjusting grasping force, the grasping force being generated by the pair of booklet grasping means when the pair of booklet grasping means grasp the booklet stopped by the sheet stopping means, wherein the folded portion flattening unit is incorporated into a post-treatment device, the post-treatment device receiving the sheet that an image is formed on by an image forming apparatus connected to the folded portion flattening unit, the post-treatment device folding and delivering the sheet, the folded portion flattening unit includes a booklet information receiving means that receives booklet information from the image forming apparatus, the booklet information forming the basis for setting the opening amount, and the grasping force adjustment means adjusts the grasping force based on the booklet information received by the booklet information receiving means, wherein the booklet information is a combination of the number of sheets, a sheet size, a sheet thickness, and a type of sheet.

5. A post-treatment device comprising:

an intermediate treatment means for folding a sheet to produce a booklet;

a sheet conveying means for conveying the booklet with a folded portion in a lead toward a predetermined conveyance direction, the booklet being produced by the intermediate treatment means;

a sheet stopping means for stopping the booklet at a predetermined position, the booklet being conveyed by the sheet conveying means;

a pair of booklet grasping means for clamping and grasping the booklet stopped by the sheet stopping means at both faces of the booklet;

a pressing means for substantially flattening a curve at a front end of the folded portion of the booklet being grasped by the booklet grasping means, by pressing the front end of the folded portion toward a direction opposite to the conveyance direction; and a grasping force adjusting means for adjusting grasping force, the grasping force being generated by the pair of booklet grasping means when the pair of booklet grasping means grasp the booklet stopped by the sheet stopping means, wherein the post-treatment device includes a booklet information receiving means that receives booklet information from an image forming apparatus, the booklet information forming the basis for adjusting the grasping force, and the grasping force adjustment means adjusts the grasping force based on the booklet information received by the booklet information receiving means, wherein the booklet information is a combination of the number of sheets, a sheet size, a sheet thickness, and a type of sheet.

6. An image forming apparatus comprising:

an image forming means for forming an image on a sheet;

an intermediate treatment means for folding the sheet to produce a booklet, the image being formed on the sheet by the image forming means;

a sheet conveying means for conveying the booklet with a folded portion in a lead toward a predetermined conveyance direction, the booklet being produced by the intermediate treatment means;

a sheet stopping means for stopping the booklet at a predetermined position, the booklet being conveyed by the sheet conveying means;

a pair of booklet grasping means for clamping and grasping the booklet stopped by the sheet stopping means at both faces of the booklet;

a pressing means for substantially flattening a curve at a front end of the folded portion of the booklet being grasped by the booklet grasping means, by pressing the front end of the folded portion toward a direction opposite to the conveyance direction; and a grasping force adjusting means for adjusting grasping force, the grasping force being generated by the pair of booklet grasping means when the pair of booklet grasping means grasp the booklet stopped by the sheet stopping means, wherein the image forming apparatus includes a booklet information receiving means that receives booklet information from the image forming means, the booklet information forming the basis for adjusting the grasping force, and the grasping force adjustment means adjusts the grasping force based on the booklet information received by the booklet information receiving means, wherein the booklet information is a combination of the number of sheets, a sheet size, a sheet thickness, and a type of sheet.

* * * * *